United States Patent [19]

Williams

[11] 4,253,579

[45] Mar. 3, 1981

[54] MODULAR BOOM CONSTRUCTION

[75] Inventor: Thomas R. Williams, Richfield, Minn.

[73] Assignee: Bucyrus-Erie Company, South Milwaukee, Wis.

[21] Appl. No.: 53,138

[22] Filed: Jun. 28, 1979

[51] Int. Cl.[3] ..... B66C 23/62

[52] U.S. Cl. ..... 52/655

[58] Field of Search ..... 212/144, 46 R, 55, 59 R; 52/655, 648, 649; 14/13, 3

[56] References Cited

U.S. PATENT DOCUMENTS

| | | | |
|---|---|---|---|
| 2,921,697 | 1/1960 | Holmes et al. | 212/144 |
| 3,021,014 | 2/1962 | Korensky et al. | 212/144 |
| 3,062,340 | 11/1962 | Hunnebeck | 52/655 |
| 3,249,238 | 5/1966 | Hedee | 212/144 |

FOREIGN PATENT DOCUMENTS

| | | | |
|---|---|---|---|
| 653967 | 6/1961 | Italy | 52/655 |

*Primary Examiner*—Robert J. Spar

*Assistant Examiner*—Kenneth Noland

*Attorney, Agent, or Firm*—Quarles & Brady

[57] ABSTRACT

A boom useful in dragline excavators, cranes and similar machines has a set of longitudinal chords defining a length along the boom and a plurality of lacings connecting the chords. These chords and lacings define a first boom section having a first pair of laterally spaced polyhedron subsections and a second boom section having a second pair of laterally spaced polyhedron subsections, the second pair of subsections being positioned longitudinally with respect to the first pair of subsections. In one embodiment, the polyhedron subsections of each boom section have transverse cross sections in the form of right triangles, with one triangle inverted with respect to the other to form a rectangular-shaped boom. Also, one boom section is reversed end to end with respect to the other boom section to have an inner chord in a subsection on one side of the first boom section in alignment with an inner chord of a subsection on the opposite side of the second boom section.

6 Claims, 13 Drawing Figures

MODULAR BOOM CONSTRUCTION

BACKGROUND OF THE INVENTION

This invention relates to booms, and more paticularly, to a modular-type boom adapted for use on dragline excavators, cranes and similar machines.

Booms for large material handling apparatus, such as dragline excavators, are subjected to high compression, tension and torsion loading. In booms of lattice type construction, the main longitudinal members are commonly called chords, and these members absorb the bulk of the compression and tension loads applied to the boom. The chords are connected to one another by a series of transversely extending lacings, or struts which lend lateral strength to the boom to resist transverse loads as occur when swinging the boom. A boom of such structure may run as long as 335 feet in length and be at least 21 feet in width along the major part of its length. Booms having such large dimensions cannot readily be shipped by conventional means, such as rail or truck because they are too long and too wide. As a result, the construction of these large booms has normally occurred in the field, and requires a considerable amount of welding at the job sites which requires substantial erection time for the boom.

The inability to ship large booms, and the resulting great amount of field time necessary for erecting such booms results in high costs, and makes it desirable to have a modular-type boom made of prefabricated subsections that may be readily shipped, and then easily assembled in the field. This would not only minimize the amount of welding that takes place in the field, but also reduce the erection time of these booms.

It is common in the art to provide booms comprised of sections that can be joined together in the field. These sections, however, are only longitudinal divisions along the boom, and each section has a width the same as the full boom width. They do not, when unassembled, reduce the width of the boom parts so that they can be shipped intact. This type of segmented boom construction is used for construction type cranes, such as truck mounted cranes, that are used at building sites. They are smaller than large dragline booms used in open pit or surface mining, and their form of construction does not have application to these larger excavators.

Some large booms for excavators may have twin columns that are transversely separated along a part of their length, as shown in Hedeen, U.S. Pat. No. 3,249,238 issued May 3, 1966. This type of boom, however, is assembled from parts by welding at the job site, and the transverse separation of twin columns does not provide any reduction in size that affords transport for boom subsections that can be readily assembled and disassembled in the field by the bolting together of the subsections.

SUMMARY OF THE INVENTION

The present invention relates to a boom having longitudinal chords defining a length along the boom and a plurality of lacings connecting the chords in which the chords and lacings define a series of longitudinally disposed and laterally spaced polyhedrons within the space defined by the outermost chords.

Large booms for excavators must normally be assembled by welding component parts together in the field. Construction of a desired structural configuration for a boom thus requires considerable erection time at the job site. The present invention seeks to reduce this erection time without sacrificing boom strength by providing a modular-type boom which is constructed along a major part of its length from identical prefabricated subsections. These subsections form longitudinal sections, with each section being subdivided along its length into subsections. Thus, the width of the finished boom is greater than the width of its prefabricated subsections. The subsections can then be transported and assembled at a job site into a boom with a final width larger than common carriers can accommodate.

To facilitate the modular character of the boom, wherein all the parts to be assembled are like subsections, the boom subsections within a single section of the boom can be laterally spaced from one another. The space will extend obliquely through the boom when seen in a transverse cross section, and a lengthwise inner chord of one subsection can then overlie an inner chord of the other subsection. Then, by reversing the position of the subsections in the next boom section the subsections can be connected successively along the length of the boom into a unitary whole in which chords of successive sections align with one another.

The reversal of the subsections from one boom section to the next balances the oblique spacing of the subsections to produce a balanced boom having adequate strength along its full length to withstand lateral forces exerted in diverse transverse directions.

In one form, the boom of the invention has successive sections of boom length each made up of subsections defined by a set of longitudinal chords and a plurality of cross lacings connecting the chords together. The subsections are laterally spaced and of polyhedron configurations having cross sections in the form of right isosceles triangles. One subsection is inverted with respect to the other to form a rectangular cross section for the boom. The sections are identical, except they are reversed end to end with respect to one another. For a boom having a width of 21 feet, the individual subsections would each be 10.5 feet wide. This latter dimension can be accommodated on a railroad flat car, whereas a 21 foot wide boom can not.

It is an object of the invention to provide a boom for excavators and other material handling apparatus comprised of prefabricated subsections that may be easily shipped by conventional means to a field site.

It is another object of the invention to reduce the erection time of a boom by providing subsections that may be readily assembled in the field without requiring extensive welding.

It is still another object of the invention to provide a boom that may readily be disassembled into subsections at one site and reassembled at a second site without building up undesirable weld stresses in its joints.

The foregoing and other objects and advantages of the invention will appear from the following description. In the description, reference is made to the accompanying drawings which form a part hereof, and in which there is shown by way of illustration and not of limitation a preferred embodiment of the invention. Such embodiment does not represent the full scope of the invention, but rather the invention may be employed in different embodiments, and reference is made to the claims herein for interpreting the breadth of the invention.

DESCRIPTION OF THE PREFERRED EMBODIMENT

Figure 1:
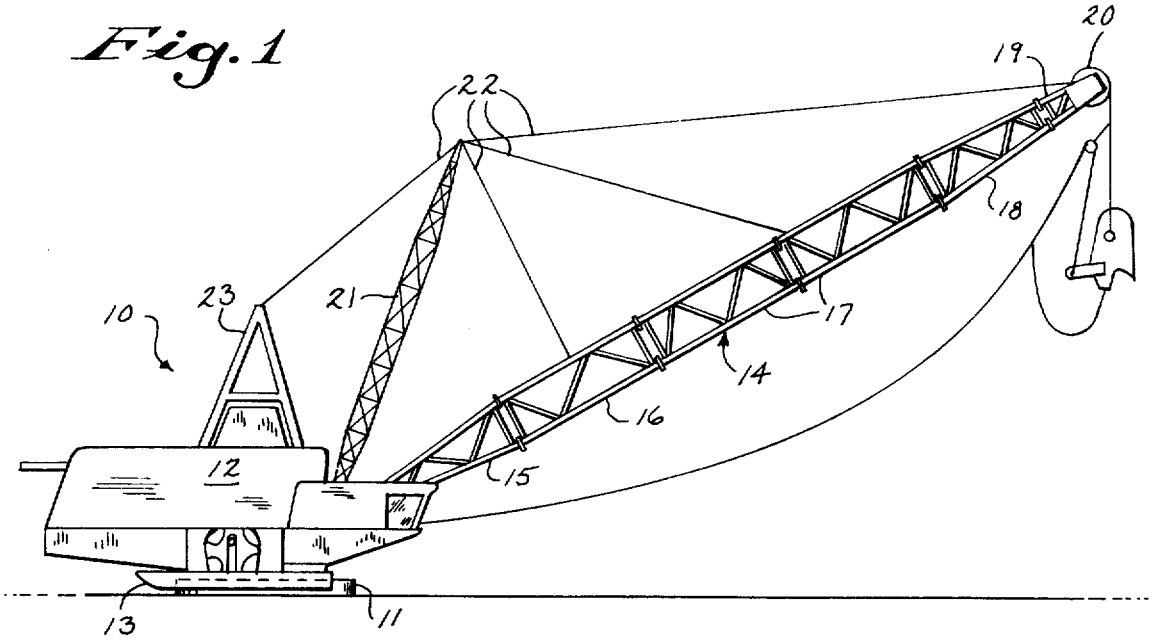
FIG. 1 is a side view in elevation of a dragline excavator employing a boom embodying the present invention.

Referring to FIG. 1, there is shown a dragline excavator designated generally by the numeral 10 having a tub 11 on which the machine rests during digging, and a machinery platform and housing 12 rotatably mounted on the tub 11 in a conventional manner. Mounted on opposite sides of the platform 12 are a pair of walking shoe mechanisms 13 that provide mobility for the excavator 10.

A boom embodying the present invention and designated generally by the numeral 14 is suitable footed on the front end of the platform 12. The boom 14 is comprised of a foot section 15 secured to the platform 12, a base section 16 extending outward from the foot section 15, a pair of mid sections 17 extending longitudinally outward from the base section 16, and a peak section 18 that narrows down to an outer boom point 19 mounting a pair of sheaves 20. Suspended from the sheaves 20 is an arrangement for dragging, hoisting and dumping. The boom 14 is conventionally supported by means of a mast 21 and stays 22 with inner stays 22 being connected to an A-frame assembly 23 supported on the platform 12.

Figure 2:
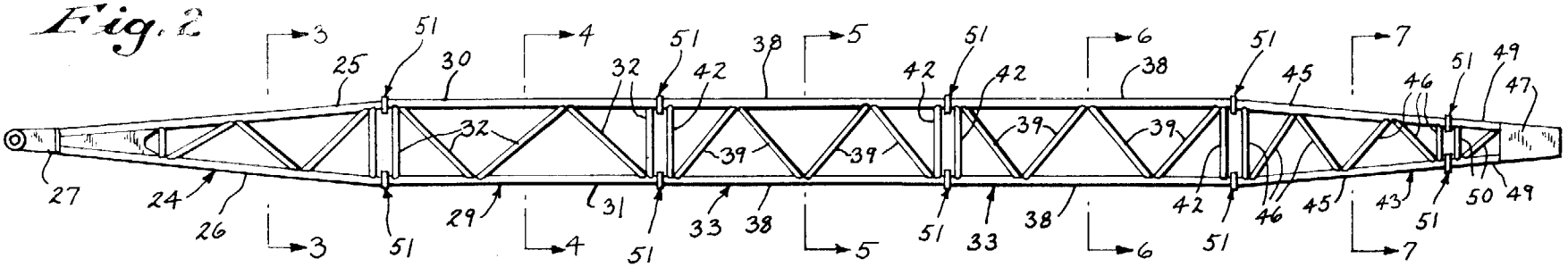
FIG. 2 is a side view in elevation of the boom in FIG. 1.
Figure 3:
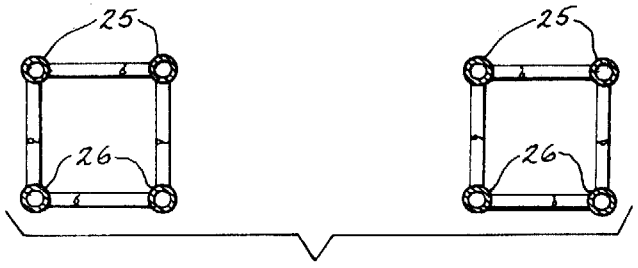
FIG. 3 is a view in section of the foot section of the boom in FIG. 1 taken in the plane 3—3 designed in FIG. 2.

Referring now to FIGS. 2-4, 8 and 9, there is shown the foot section 15 and base section 16 of the boom 14. The foot section 15 is comprised of left hand and right hand legs 24 having rectangular transverse cross sections as shown in FIG. 3. Each leg 24 has a pair of upper chords 25 and a pair of lower chords 26 that diverge from a boom foot 27 to connect with the base section 16. Thus, the chords 25,26 of a foot section 24 have a common connection at their inner ends with their boom foot 27 and spread from one another to form tapered legs 24. The chords 25,26 are connected to one another by intermediate, oblique lacings 28 which give added strength to the structure of the foot section 15.

Figure 4:
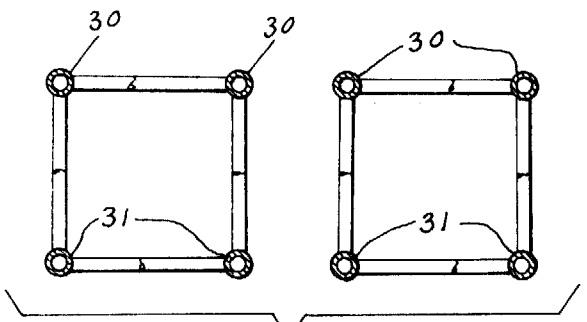
FIG. 4 is a view in section of the base section of the boom in FIG. 1 taken in the plane 4—4 designated in FIG. 2.
Figures 8, 9, 13:
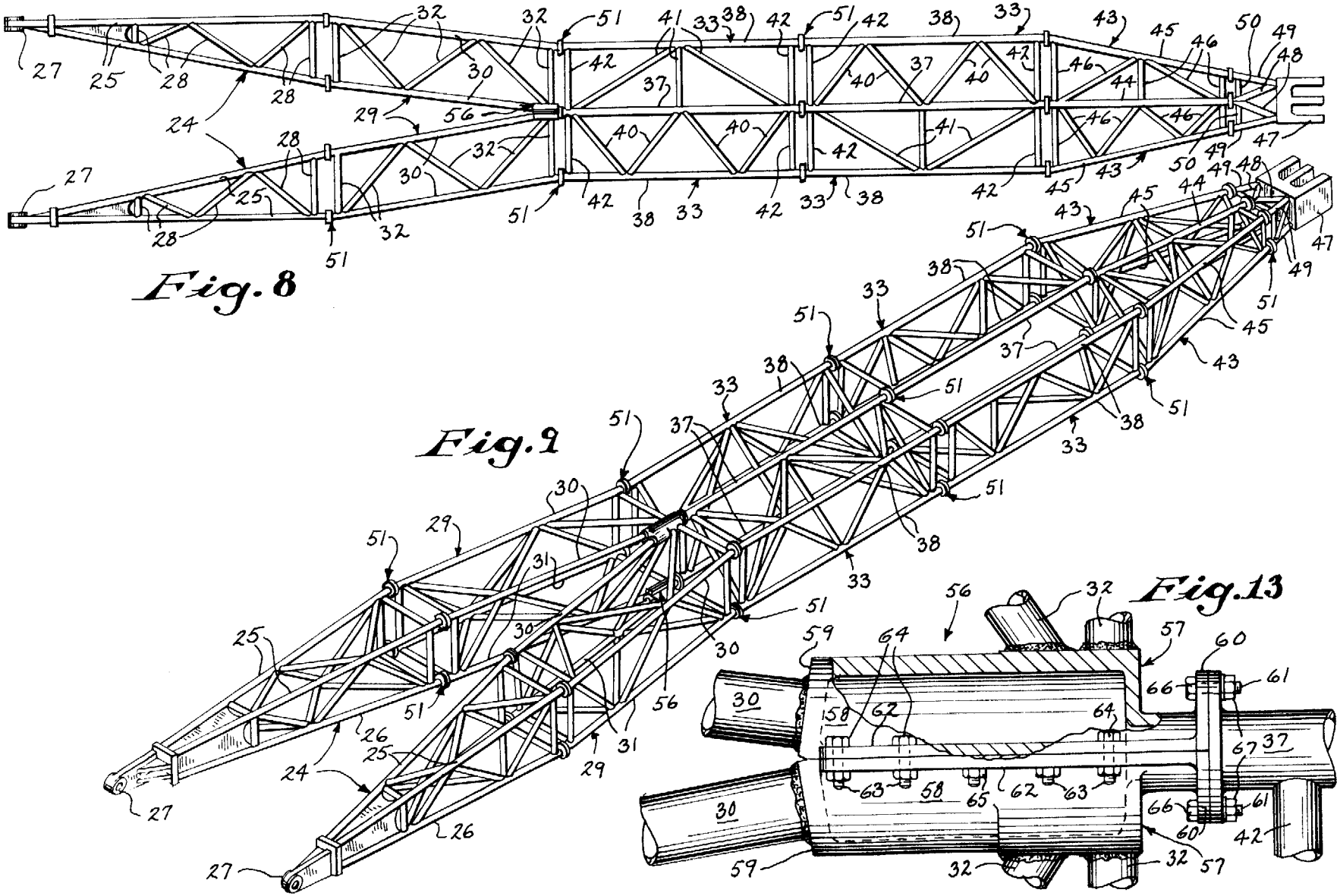
FIG. 8 is a top view of the boom.
FIG. 9 is a view in perspective of the boom.
FIG. 13 is a fragmentary top view with parts cut away of a coupling for connecting the inside chords of the base section to one another and to the central chords of the first mid section of the boom.

The base section 16 is comprised of left hand and right hand columns 29 having rectangular transverse cross sections, as shown in FIG. 4. As seen best in FIG. 8, the columns 29 are disposed between the foot section 15 and the first boom mid section 17, and are spaced outwardly from the center of the boom 14 at their inner ends to form a generally inverted V-shaped structure, as seen in FIG. 8, to match the position and depth of the legs 24 of the foot section 15. Each column 29 has a pair of upper chords 30 and a pair of lower chords 31 connected at their inner ends to the upper chords 25 and lower chords 26 of the legs 24, and at their outer ends to the chords of the first boom mid section 17, as will hereinafter be described. Thus, the chords 30,31 of the columns 29 form extensions of the chords 25,26 of the legs 24. The outside upper chord 30 of the left hand column 29 is connected at its inner end to the outside upper chord 25 of the left leg 24, and the inside upper chord 30 of the left hand column 29 is connected at its inner end to the inside upper chord 25 of the left leg 24. The outside lower chord 31 of the left hand column 29 is connected at its inner end to the outside lower chord 26 of the left leg 24, and the inside lower chord 31 of the left hand column 29 is connected at its inner end to the inside lower chord 26 of the leg 24. The right hand column 29 is similarly connected to the right leg 24 of the foot section 15. The inside upper and lower chords 30,31 are connected at their inner ends to the inside upper and lower chords 25,26 of the right leg 24, and the outside upper and lower chords 30,31 are connected at their inner ends to the outside upper and lower chords 25,26 of the right leg 24.

The chords 30,31 of the columns 29 are connected to one another by intermediate lacings 32 to give added strength to the structure of the base section 16. The lacings 32 are disposed between the chords 30,31 in generally zig-zag patterns similar to the patterns of the lacings 28 of the foot section 15. These zig-zag patterns provide strength to adequately reinforce the boom against lateral and torsional forces.

Figure 11:
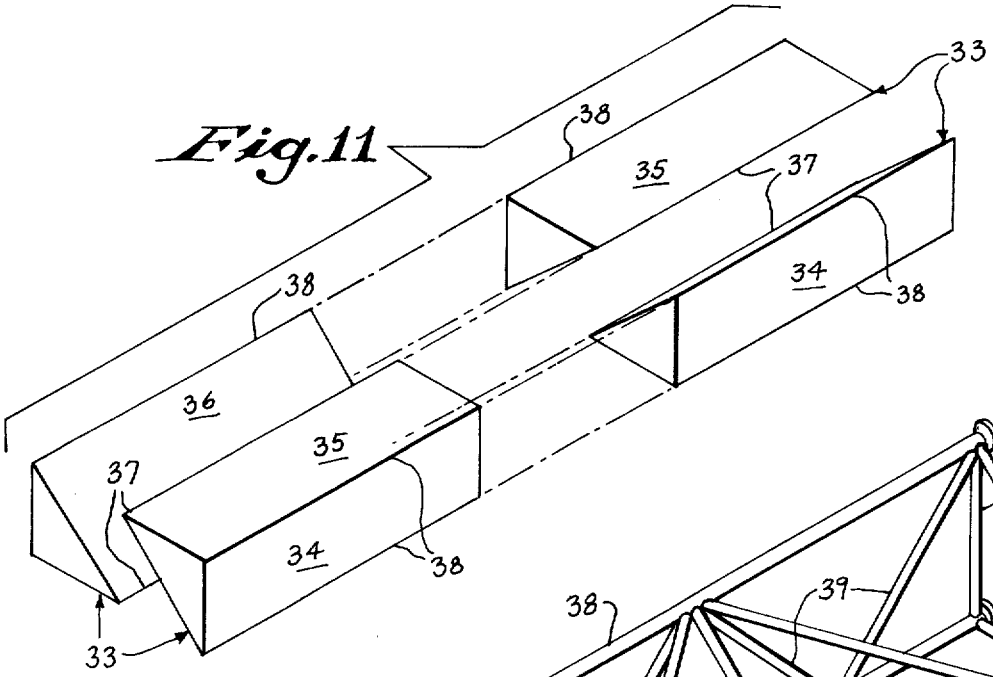
FIG. 11 is a schematic view in perspective of the mid portion of the boom in FIG. 1 showing the geometric envelopes of subsections for a pair of successive boom mid sections with lacings between chords omitted to clarify the arrangement of the subsections.
Figure 5:
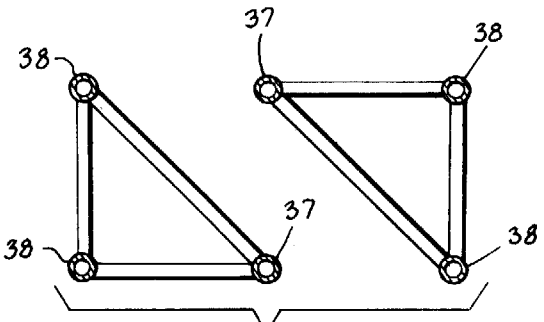
FIG. 5 is a view in section of the first mid section of the boom in FIG. 1 taken in the plane 5—5 designated in FIG. 2.
Figure 6:
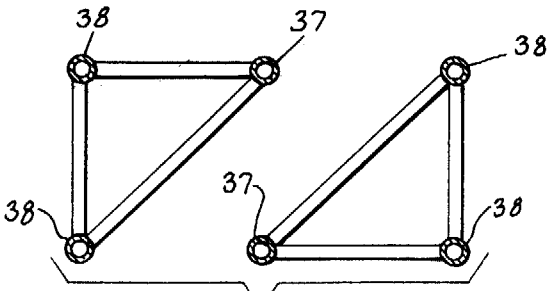
FIG. 6 is a view in section of the next mid section of the boom in FIG. 1 taken in the plane 6—6 designated in FIG. 2.

Referring now to FIG. 11, there is shown the geometric envelopes of the two successive boom mid sections 17. Only the geometric envelopes of the mid sections 17 have been shown, so that this particular figure may more clearly illustrate the arrangement of the subsections that make up the mid sections. The mid sections 17 are each comprised of a pair of subsections 33 which extend the entire length of each boom mid section 17. All four subsections 33 are also identical, but occupy relatively different positions. Thus, one subsection 33 in each mid section 17 is inverted, or reversed, top to bottom with respect to the position of the other subsection 33 of the mid section. Also, the subsections 33 of one mid section 17 are inverted, or reversed, with respect to those of the adjacent mid section 17, as seen by comparing FIGS. 5 and 6.

Each subsection 33 is in the form of a polyhedron with a transverse cross section geometry of a right isosceles triangle. The subsections 33, as seen in FIG.

11, each present a side face 34 forming a side of the boom 14, a lateral face 35 forming either the top or bottom surface of the boom 14, depending upon its particular orientation, and an oblique center face 36 which is in the interior of the boom 14 and forms the hypotenuse of the triangular cross section. The two subsections 33 of a boom mid section 17 are laterally spaced from one another to present a left hand, or port subsection 33, and a right hand, or starboard subsection 33. The center face 36 of the left hand subsection 33 faces the center face 36 of the right hand subsection 33. This lateral spacing of adjacent subsections 33 results in a diagonal space between the two subsections which runs for the entire length of a boom mid section 17. This space in the first mid section 17 runs from the upper left of the boom 14 diagonally down to the lower right, and the space in the second mid section 17 runs from the upper right of the boom 14 downward to the lower left. Thus, the spaces are reversed from boom section to boom section in alternate positions.

Each subsection 33 is comprised of three longitudinal tubular chords which form the edges of their polygonal form. The left hand or port subsection 33 of the first boom mid section 17 has a center, or inner chord 37, along the bottom of the boom 14 positioned directly below and in vertical alignment with the center or inner chord 37 of the right hand or starboard subsection 33 which runs along the top of the boom 14 so that these two chords present central chords running along the length of the boom 14. The two remaining chords of each subsection 33 present upper and lower side chords 38. These side chords 38 form the edges of the sides of the boom 14. In the first mid section 17, the side face 34 of the port subsection 33 forms a portion of the left side of the boom 14, and the side face 34 of the starboard subsection 33 forms a portion of the right side of the boom 14. The lateral face 35 of the port subsection 33 runs along the bottom of the boom 14, and the lateral face 35 of the starboard subsection 33 runs along the top of the boom 14. Thus, a length of center boom section 17 has six longitudinal chords divided into three upper chords running along the top of the boom 14 and three lower chords running along the bottom of the boom 14, and the cross section geometry of an entire boom mid section 17 is rectangular.

FIG. 11 also shows a second, or successive boom mid section 17 which is comprised of two subsections 33 that are identical to the two subsections 33 of the first center section 17, except they are orientated differently as stated above. The center chord 37 of the port subsection 33 is now along the top of the boom 14, and the center chord 37 of the starboard subsection 33 is along the bottom of the boom 14. As in the first boom mid section 17, the side faces 34 of each subsection 33 in the second boom mid section 17 form portions of the sides of the boom 14. However, the lateral face 35 of the port subsection 33 now runs along the top of the boom 14 and the lateral face 35 of the starboard subsection 33 now runs along the bottom of the boom 14. It should be noted that if a next or third succeeding boom mid section 17 is desired, it would be orientated in exactly the same manner as the first mid section 17 and connected to the second mid section 17. A fourth mid section 17 would be oriented as the second, a fifth like the first, and so on until the desired boom length is obtained. Thus, a unitary boom 14 results even though each boom mid section 17 is subdivided into two separate and distinct subsections 33 that are laterally spaced from one another. The subsections 33 also have a plurality of lacings that extend between and are welded to the longitudinal chords 37 and 38.

Figure 10:
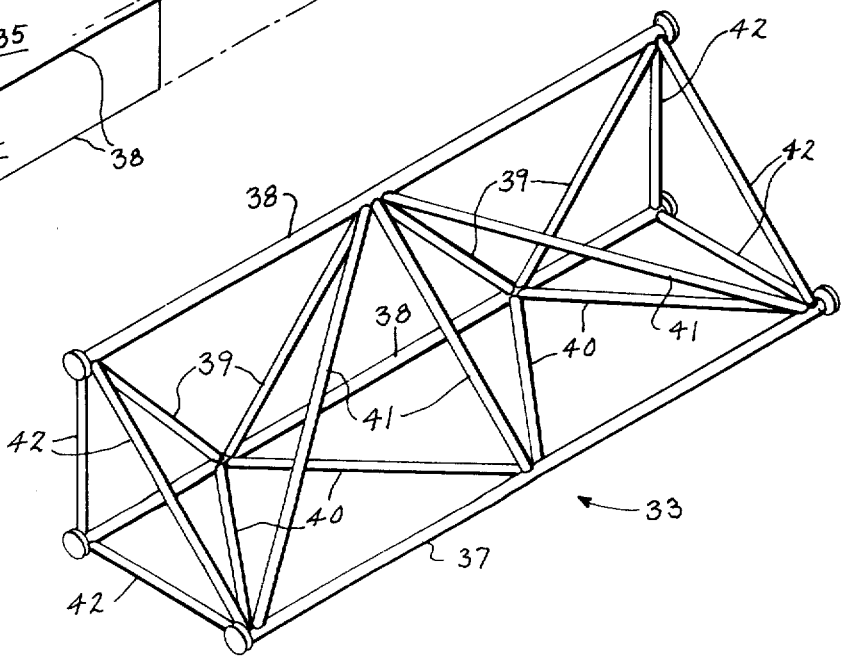
FIG. 10 is a perspective view of a subsection used in the boom mid sections showing the geometric relation of its chords and lacings.

Since the subsections 33 are identical, only the lacings of one subsection need be described, and reference is made to FIG. 10 for their description. As seen there, the lacings are disposed in the planes of the side face 34, lateral face 35, and center face 36 of the subsection 33. In the side face 34, the first lacing 39 starts at the upper side chord 38 and runs obliquely down to the lower side chord 38. The second lacing 39 then runs obliquely from the lower side chord 38 back to the upper side chord 38. The third and fourth lacings 39 repeat the pattern of the first and second lacings 39 to produce a zig-zag arrangement.

In the lateral face 35 of the subsection 33 of FIG. 10, there is a first lacing 40 starting at the lower center chord 37 and running obliquely to the lower side chord 38. A second lacing 40 then runs from the lower side chord 38 obliquely back to the lower center chord 37. Third and fourth lacings 40 repeat the pattern of the first and second lacings 40 to produce a zig-zag arrangement. It will be noted that the first and second lacings 40 have common points of connection or joints on the lower side chord 38, the second and third lacings 40 have a common joint on the lower center chord 37, and the third and fourth lacings 40 have a common joint on the lower side chord 38.

The center face 36 of the subsection 33 has a transverse middle lacing 41 that laterally bisects the length of the face 36 and extends from the lower center chord 37 to the upper side chord 38. Two diagonal lacings 41 are connected together at their upper ends at the point where the middle lacing 41 is welded to the upper side chord 38. These lacings 41 each extend downwardly in a diagonal direction to the lower center chord 37.

In addition to the lacings 39–41, the subsection 33 also includes end lacings 42 which are normal to the chords 37,38 and adjacent the chord ends. There are three such end lacings 42 at each end of the subsection 33.

In connecting the subsections 33 of the first mid section 17 to the boom base section 16, the side chords 38 of the left hand subsection 33 align with and abut at their lower ends with left side chords of the base section 16, and similarly the side chords 38 of the right hand subsection 33 align with and abut at their lower ends with the right side chords of the base section 16. The two central or inner chords 38 of the first mid section 17 align with and abut the four central chords of the base section 16, where the two columns 29 come together in a "V," so that the chords of the boom 14 form continuous, longitudinal members as in usual boom constructions.

Figure 7:
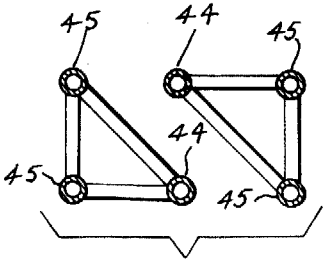
FIG. 7 is a view in section of the boom peak section of the boom in FIG. 1 taken in the plane 7—7 designated in FIG. 2.

At the outer end of the second boom mid section 17, there is a juncture with the boom peak section 18. The peak section 18 is comprised of two separate, but identical, subsections 43 having triangular cross sections as shown in FIG. 7. The left hand subsection 43 is inverted or reversed top to bottom with respect to the position of the right hand subsection 43. The subsections 43 of the peak section 18 are similar to the subsections 33 of the center sections 17, in that each is comprised of a center or inner chord 44 and two side chords 45 one above the other. The center chords 44 are also disposed one above the other along the longitudinal center axis of the boom 14, and present longitudinal extensions of the center chords 37 of the boom mid sections 17. The side chords 45 form continuations of the side chords 38 of the mid sections 17, and they converge outwardly to a boom point section 19 forming the tip of the boom 14. The chords 44,45 further present center, side and lateral faces similar to those presented by the subsections 33 of the center boom sections 17. Disposed in the planes of these faces are intermediate lacings 46 which connect the chords 44,45 together in patterns like those found in the boom mid sections 17. Thus, as seen best in FIGS. 8 and 9, the orientation of the subsections 43 of the boom peak section 18 is such that they are reversed end to end with respect to the position of the outermost boom mid section 17. A diagonal space between the two boom peak subsections 43 is thus reversed from the space in the outer section 17.

In assembling the subsections 43 of the peak section 18 to the subsections 33 of the second boom mid section 17, the upper side chord 45 of the port subsection 43 is connected at its inner end to the upper side chord 38 of the port subsection 33 of the section 17, and the lower side chord 45 of the port subsection 43 is connected at its inner end to the lower side chord 38 of the port subsection 33 of the second section 17. The center chord 44 of the port subsection 43 is connected at its inner end to the center chord 37 of the starboard subsection 33 of the second section 17, and the center chord 44 of the starboard subsection 43 is connected at its inner end to the center chord 37 of the port subsection 33 of the second section 17. Finally, the upper side chord 45 of the starboard subsection 43 is connected at its inner end to the upper side chord 38 of the starboard subsection 33 of the section 17, and the lower side chord 45 of the starboard subsection 43 is connected at its inner end to the lower side chord 38 of the starboad subsection 33 of the section 17. In this manner, the chords 44,45 of the peak section 18 form longitudinal extensions of the chords 37,38 of the mid sections 17.

At the outer end of the boom peak section 18 there is a juncture with the boom point section 19 having a sheave mounting 47 at its tip. As shown in FIGS. 2, 8 and 9, the point section 19 is comprised of center or inner chords 48, side chords 49 connected to the sheave mounting 47, and lacings 50 which connect the chords 48,49 together. The inner chords 48 form a pair of Y-shaped chord structures which are disposed one above the other along the longitudinal center axis of the boom 14. Each Y-shaped chord structure includes a first inner chord 48 which forms a longitudinal extension of the center chord 44 of the subsections 43 of the peak section 18, and a pair of second inner chords 48 which diverge outwardly and downwardly from the upper end of the first inner chord 48 to connect with the sheave mounting 47. The side chords 49 are disposed one above the other to form continuations of the side chords 45 of the peak section 18, and converge outwardly to connect with the sheave mounting 47. Disposed between the side chords 49 and inner chords 48 are intermediate lacings 50 which run transversely from the side chords 49 to the juncture of each Y-shaped inner chord structure. Disposed between each pair of upper and lower side chords 49 are two additional lacings 50. The first lacing 50 runs transversely between the upper and lower chords 49, and the second lacing 50 starts at the lower side chord 49 and runs obliquely upward to the upper side chord 49. The lacings 50 are welded to the chords 48,49, and the chords 48,49 are also welded to the sheave mounting 47 so that a unitary boom point section 19 results that may be readily shipped as a unit.

In connecting the boom point section 19 to the boom peak section 18, the left side chords 49 align with and abut at their lower ends with the side chords 45 of the left hand subsection 43 of the peak section 18, and similarly the right side chords 49 align with and abut at their lower ends with the side chords 45 of the right hand subsection 43 of the peak section 18. The first central or inner chord 48 of each Y-shaped chord structure aligned with and abuts at its lower end with the inner chords 44 of the peak section 18. Thus, the chords of the boom 14 form continuous, longitudinal members throughout its entire length.

Figure 12:
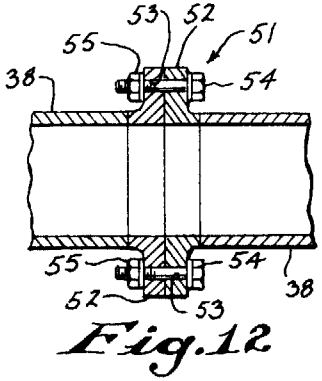
FIG. 12 is a fragmentary view in section of a bolted joint for connecting sections of the boom to one another.

The components of the boom comprising the legs 24 of the foot section 15, the columns 29 of the base section 16, the subsections 33 of the mid sections 17, the subsections 43 of the peak section 18, and the point section 19 are connected at each other by the use of bolted joints 51 formed at the ends of their chords, respectively. A typical joint is shown in FIG. 12 where the ends of two chords 38 of a pair of successive subsections 33 have circular flanges 52 mounted on their ends. The flanges 52 each have a series of circumferentially spaced openings 53 that are aligned to receive the shafts of a series of assembly bolts 54. Nuts 55 are brought up tightly to firmly secure and join successive sections of the boom 14.

The two columns 29 of the base section 16 are also jointed to one another and to the first mid section 17 at the apex of the "V" by the bolted coupling 56 shown in FIG. 13. The coupling 56 joins the inside upper and lower chords 30 of the columns 29 to one another and to the central chords 37 of the subsections 33 of the first mid section 17. The coupling 56 includes a pair of identical sectors 57 that are mounted to the ends of the chords 30, and face one another in a complementary or matching fashion. Each sector 57 has a semi-cylindrical hollow body portion 58 having an integrally formed abutment 59 at one end and an integrally formed semi-circular flange 60 that projects radially outward from its other end. Each sector 57 is welded at the abutment 59 to the ends of the chords 30 to firmly secure the sectors 57 in place. The flanges 60 each have a series of circumferentially spaced openings 61 formed therein. Each body portion 58 also has a pair of integrally formed elongated flanges 62 that project radially outward from the ends of its lateral surface. The elongate flanges 62 extend laterally between the abutment 59 and the semi-circular flange 60, and have a series of longitudinally spaced openings 63 formed therein. Thus, when the two sectors 57 are placed in facing relation to one another, as shown in FIG. 13, the elongate flanges 62 of one body portion 58 face the elongate flanges 62 of the other body portion 58, and the semi-circular flanges 60 match each other to form a complete circular flange similar to the circular flanges 52 of the bolted joints 51. When the two sectors 57 are placed in facing relation to one another, the openings 63 are also aligned to receive the shafts of a series of fastening bolts 64. Nuts 65 are brought up tightly to secure and join the chords 30 together. In order to join the chords 30 to the two central chords 37 of the first mid section 17, the openings 61 in the flanges 60 are aligned with the openings 53 in the flanges 52 mounted on the ends of the chords 37, and the shafts of a series of fastening bolts 66 are inserted therethrough. Nuts 67 are then brought up tightly to firmly secure and join the chords 30,37. The coupling 56 may be cast as an integral unit, or its individual components may be welded together to form an integral coupling 56.

It is intended that the assembly of the base section columns 29, and of the attachment of the legs 24 will all occur in the field. Each of these components is of a width no greater than that of a subsection 33, and hence each can be prefabricated and delivered to the erection site.

A boom 14 has been shown and described which includes a series of longitudinally aligned mid sections and a peak section that are each subdivided longitudinally into components or subsections of widths less than the width of the assembled boom. As a result, when these sections are unassembled the individual components or subsections can be transported as prefabricated, modular units, which when assembled provide a boom larger in width than can be transported by common carriers. To facilitate assembly of the subsections, they have a configuration in which a central or inner chord of one subsection of a boom section is vertically aligned with a central or inner chord of the other subsection. Then in the next boom sections, identical subsections can be used which by reversal of their position can attach in the center region of the boom directly to the adjacent boom section without the necessity of additional parts or complex fittings. A unique aspect of this construction is the attachment of a central chord of a subsection on one side of a first boom section to a central chord of a subsection on the opposite side of the next boom section. Also, the subsections of a boom section can be spaced laterally from one another to facilitate the central chord connections, and such space alternates in positions from boom section to boom section.

In the illustrated embodiment of the invention, the polyhedral subsections 33,43 have cross section geometries of right isosceles triangles. Various modifications in this geometry are possible. Cross sections of various polygons, such as scalene triangles and quadrilaterals might be substituted. Also, a boom section could be comprised of three or more subsections spaced transversely across the boom.

I claim:

1. In a boom, the combination comprising: a first longitudinally extending boom section having laterally spaced polyhedral subsections that are each formed of a set of longitudinal chords and cross lacings between the chords, an inner chord of one subsection being vertically aligned with an inner chord of another subsection;

a second longitudinally extending boom section having laterally spaced polyhedral subsections that are each formed of a set of longitudinal chords and cross lacings between the chords, an inner chord of one subsection of said second boom section being vertically aligned with an inner chord of another subsection of said second boom section;

said first and second boom sections being joined to one another with an inner chord of a subsection on one side of the first boom section being connected to an inner chord of a subsection on the opposite side of the second boom section.

2. A boom as in claim 1 with the subsections in each boom section being laterally spaced with the spacing running obliquely within the boom section, and the oblique direction in one section being reversed from that in the other section.

3. In a boom, the combination comprising:

a first boom section having laterally spaced polyhedral subsections that are inverted with respect to each other, each subsection having a plurality of chords including an inner chord, a second boom section having laterally spaced polyhedral subsections that are inverted with respect to each other, said second boom section having a cross section geometry which is the reverse of said first boom section with each subsection having a plurality of chords including an inner chord;

said first and second boom sections joined to one another with an inner chord of a subsection on one side of the first boom section being connected to an inner chord of a subsection on the opposite side of the second boom section.

4. A boom as in claim 3, wherein the subsections of a boom section are polygonal in transverse sections, there is an oblique spacing between the subsections of a boom section, the second boom section is reversed in position from the first boom section, and the inner chords of the subsections of a section lie in vertical alignment with one another.

5. A boom as in claim 4, wherein the outer chords of one boom section align with the outer chords of the other boom section.

6. In a boom, the combination comprising:

a first longitudinally extending boom section formed of a set of longitudinal chords and a plurality of cross lacings connecting said chords;

a second longitudinally extending boom section formed of a set of longitudinal chords and a plurality of cross lacings connecting said chords;

said chords and lacings defining a first pair of laterally spaced polyhedral subsections within said first section, and a second pair of laterally spaced polyhedral subsections within said second section;

each polyhedral subsection has a cross section geometry of a right isosceles triangle, and the laterally spaced subsections of a section of the boom are inverted with respect to each other so that an inner chord of one subsection is vertically aligned with an inner chord of the other subsection;

said second pair of subsections further being spaced longitudinally from said first pair of subsections, and said second section of the boom has a cross section geometry which is the reverse of said first section; and said first and second boom sections joined to one another an inner chord of a subsection on one side of the first boom section being connected to an inner chord of a subsection on the opposite side of the second boom section.

* * * * *